US007204704B2

(12) United States Patent
Yamamoto

(10) Patent No.: US 7,204,704 B2
(45) Date of Patent: Apr. 17, 2007

(54) WIRE HARNESS INCLUDING HOOK AND LOOP SHAPED ATTACHING MEMBERS AND A METHOD OF ATTACHING A WIRE HARNESS USING THE SAME

(75) Inventor: Masataka Yamamoto, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/350,838

(22) Filed: Feb. 10, 2006

(65) Prior Publication Data

US 2006/0189193 A1 Aug. 24, 2006

(30) Foreign Application Priority Data

Feb. 21, 2005 (JP) ..... P2005-044235

(51) Int. Cl.
*H01R 29/00* (2006.01)

(52) U.S. Cl. ..... 439/174; 174/72 A; 439/290

(58) Field of Classification Search ..... 439/174, 439/290, 258; 174/44, 72 A; 29/876
See application file for complete search history.

(56) References Cited

U.S. PATENT DOCUMENTS 3,464,094 A * 9/1969 Mates ..... 24/443
4,191,950 A * 3/1980 Levin et al. ..... 340/604
4,239,046 A * 12/1980 Ong ..... 600/391
5,774,341 A * 6/1998 Urbish et al. ..... 361/774
5,906,507 A * 5/1999 Howard ..... 439/501
6,439,495 B1 * 8/2002 Bolen et al. ..... 242/388

FOREIGN PATENT DOCUMENTS

GB 2276279 A * 9/1994
JP 6-64324 U 9/1994

* cited by examiner

*Primary Examiner*—Michael C. Zarroli
(74) *Attorney, Agent, or Firm*—Sughrue Mion, PLLC

(57) ABSTRACT

A wire harness includes an insulating member that contains a conductor therein, the conductor extending along one direction, and the insulating member having a front face and a back face that is opposed to the front face and a plurality of hook-shaped members and a plurality of loop-shaped members that are provided on at least one of the first face and the back face of the insulating member. The hook-shaped members are engageable to loop shaped members of a mating wire harness to be laminated to the wire harness. The loop-shaped members are engageable to hook shaped members of the mating wire harness.

6 Claims, 6 Drawing Sheets

WIRE HARNESS INCLUDING HOOK AND LOOP SHAPED ATTACHING MEMBERS AND A METHOD OF ATTACHING A WIRE HARNESS USING THE SAME

BACKGROUND OF THE INVENTION

The present invention relates to a wire harness fitted to a car, or the like and a wire harness attaching method and, more particularly, a wire harness that can be installed even when front and back faces of the wire harness are reversed and can reduce a cord providing space and a wire harness attaching method.

The progress in a car, a copying machine, a ticket machine, etc. equipped with electronic equipments has been notable in recent years. The wire harness is employed as the wiring system to transfer information and energy that are indispensable for these equipments.

For example, several hundreds of high-performance electric wires are needed to operate precisely an engine, meters, lights, etc. of the car. The wire harness is employed to tie up such electric wires and information circuits compactly in a bundle.

As the wire harness, normally there are the flat type in which core electric wires as conductors are aligned like a flat surface and the bundle type constituting a group of electric wires.

Since the flat-type wire harness has a small thickness, such wire harness has advantages that it does not occupy much space, it makes the cord provision simple, and the like. Also, since the specification of the core electric wires is different according to the applied portion, the wire harnesses that fit in with the applied portions are often employed in a laminated fashion (see JP-UM-A-6-64324, for example).

In JP-UM-A-6-64324, the flat harness and the flat harness fixing structure have a structure shown in FIG. 11 and FIG. 12 respectively.

More particularly, as shown in FIG. 11, a flat harness 50 is formed by putting opposing surfaces of a conductive material 51, which continues in one direction, between insulating films 52. A laminated fabric 54 is adhered onto outer surfaces of the insulating films 52 via an adhesive agent 53 respectively. Also, female engagement portions 55 are implanted on the laminated fabric 54 on one side, and male engagement portions 56 are implanted on the laminated fabric 54 on the other side.

In attaching the flat harnesses 50 having the above structure, as shown in FIG. 12, two sheets of flat harnesses 50A, 50B are laminated in such a way that the male engagement portions 56 on the second flat harness 50B are engaged with the female engagement portions 55 on the first flat harness 50A respectively. Then, three sheets of flat harnesses 50A, 50B, 50C are laminated such that the male engagement portions 56 on the third flat harness 50C are engaged with the female engagement portions 55 on the second flat harness 50B respectively.

However, in the flat harness laminated structure in JP-UM-A-6-64324, the problems described in the following exist. First, in this flat harness laminated structure in JP-UM-A-6-64324, the female engagement portions 55 and the male engagement portions 56 are provided to the surface of the flat harness 50 on one side and the surface on the other side respectively. Therefore, the female engagement portions 55 and the male engagement portions 56 on the flat harnesses 50A, 50B must be engaged to oppose mutually in attaching the flat harnesses 50A, 50B, etc. Accordingly, there is the problem that respective directions of the flat harnesses 50A, 50B are determined and thus the flat harnesses 50A, 50B cannot be used in a reversed mode of their front and back surfaces.

Consequently, for example, when the worker holds the flat harness 50 to be laminated in his or her hand and then engages it with the first flat harness 50A, first such worker must check which one of the female engagement portions 55 and the male engagement portions 56 appears on the surface of the first flat harness 50A, and then the worker must check the type of fibres on the flat harness 50 in his or her hand to correspond to the appeared female engagement portions 55 or male engagement portions 56.

Normally the flat harnesses to be laminated are orderly managed such that the worker can conduct effectively the attaching operation as it is when he or she holds the flat harness in his or her hand, nevertheless for some reason the flat harness is placed in its reversed state. The worker assumes that the flat harness can be laminated immediately and pushes the flat harness in his or her hand against the opposing flat harness, but the female engagement portions 55 and the male engagement portions 56 do not meet face to face. Therefore, the worker must turn the flat harness in his or her hand upside down and then push it once again, so that such attaching operation takes a lot of time and effort.

Also, the flat wire harness is constructed by attaching sequentially the insulating film 52, the adhesive agent 53, the laminated fabric 54, and the female engagement portions 55 or the male engagement portions 56 on the front and back surfaces of the conductive material 51 respectively, and the overall structure is constructed like a flat plate. Therefore, in case such laminated flat harnesses 50 are fitted the body of the car, or the like, a cord providing space having a thickness equivalent to the number of laminated sheets is needed. Supposing that a number of flat harnesses are laminated by using the laminated structure in JP-UM-A-6-64324, such thickness occupies a space on the interior side correspondingly to narrower an interior space.

SUMMARY OF THE INVENTION

It is an object of the present invention to provide a wire harness that can be used even when front and back surfaces of the wire harness are reversed and a wire harness attaching method.

Also, it is another object of the present invention to provide a wire harness and a wire harness attaching method capable of reducing a cord providing space.

(1) A flat type of a wire harness of the present invention plural sheets of which can be laminated, wherein the wire harness is constructed to contain an insulator portion to an inside of which a conductor continuing in one direction is provided, a number of hook-shaped members and a number of loop-shaped members are provided on either of front and back surfaces of the insulator portion, and the hook-shaped member and the loop-shaped members are engaged with the loop-shaped members and the hook-shaped members of an opposing wire harness to be laminated respectively.

According to the wire harness having the above configuration, a number of hook-shaped members and a number of loop-shaped members are provided on either of the front and back surfaces of the insulator portion of the wire harness. Therefore, the same wire harness is reversed and then the hook-shaped members and the loop-shaped members of two sheets of wire harnesses can be engaged mutually. As a result, the wire harness can be used even when such wire harness is reversed.

(2) In the present invention, in the wire harness according to (1), the insulator portion is formed to contain a plurality of conducting portions which are arranged at a predetermined interval and into insides of which the conductor is inserted respectively, and bridge portions which couple the conducting portions mutually and a thickness of which is smaller than the conducting portions, the hook-shaped members are implanted on either of front and back surfaces of the conducting portions, and the loop-shaped members are implanted on either of front and back surfaces of the bridge portions.

According to the wire harness having the above configuration, a thickness of the bridge portions is smaller than that of the conducting portions, and two sheets of wire harnesses are laminated by engaging a number of hook-shaped members implanted on the conducting portions with the loop-shaped members implanted on the bridge portions. As a result, a total thickness can be reduced by a half of a thickness difference between the conducting portion and the bridge portion rather than the case where the conducting portions are brought into contact with each other, and thus a cord providing space can be reduced.

(3) In the present invention, in the wire harness according to (1), the insulator portion is formed to contain a plurality of conducting portions which are arranged at a predetermined interval and into insides of which the conductor is inserted respectively, and bridge portions which couple the conducting portions mutually and a thickness of which is smaller than the conducting portions, the hook-shaped members are implanted on both front and back surfaces of the conducting portions, and the loop-shaped members are implanted on both front and back surfaces of the bridge portions.

According to the wire harness having the above configuration, the hook-shaped members and the loop-shaped members are implanted on both the front surface and the back surface of the conducting portions and the bridge portions of the wire harnesses respectively. Therefore, plural sheets of wire harnesses can be laminated only by pushing them after the wire harnesses are arranged to overlap the conducting portions and the bridge portions respectively. As a result, since there is no need to check which one of the front surface and the back surface of the wire harnesses in his or her hand is prepared to laminate, such an advantage can be achieved that the fitting operation can be applied in a situation that the wire harness is reversed and also such fitting operation can be facilitated.

(4) A wire harness attaching method of the present invention of attaching the wire harness set forth (2) or (3), wherein plural sheets of wire harnesses are laminated by opposing the conducting portions and the bridge portions of respective wire harnesses to each other to shift the laminated wire harnesses mutually in mutual width directions, then overlapping both wire harnesses with each other, and then engaging the hook-shaped members on the conducting portions with the loop-shaped members on the bridge portions.

According to the wire harness attaching method having the above configuration, plural sheets of wire harnesses are laminated by engaging a number of hook-shaped members implanted on the conducting portions, a thickness of each of which is smaller than the conducting portion of the wire harness, with the loop-shaped members implanted on the bridge portions. As a result, a total thickness can be reduced by a half of a thickness difference between the conducting portion and the bridge portion rather than the case where the conducting portions are brought into contact with each other, and thus a cord providing space can be reduced.

According to the present invention, there is also provided a wire harness, comprising:

an insulating member that contains a conductor therein, the conductor extending along one direction, and the insulating member having a front face and a back face that is opposed to the front face; and a plurality of hook-shaped members and a plurality of loop-shaped members that are provided on at least one of the first face and the back face of the insulating member, wherein the hook-shaped members are engageable to loop shaped members of a mating wire harness to be laminated to the wire harness; and wherein the loop-shaped members are engageable to hook shaped members of the mating wire harness.

Preferably, the insulating member includes a plurality of conducting portions and a plurality of bridge portions that couple the conducting portions. The conducting portions are arranged at a predetermined interval and have a plurality of the conductors respectively. The thickness of the bridge portions is smaller than that of the conducting portions. The hook-shaped members are provided on at least one of front faces and back faces of the conducting portions. The loop-shaped members are provided on at least one of front face and back face of the bridge portions.

Preferably, The hook-shaped members are provided on both the front faces and the back faces of the conducting portions. The loop-shaped members are provided on both the front faces and the back faces of the bridge portions.

Preferably, the hook-shaped members are provided on either the front faces or the back faces of the conducting portions. The loop-shaped members are provided on either the front faces or the back faces of the bridge portions.

According to the present invention, there is also provided a method of attaching at least two wire harnesses, comprising:

arranging the at least two wire harnesses that are opposed to and shifted to each other so that the conducting portions of the respective wire harnesses are opposed to the bridge portions of the respective wire harnesses; and attaching the at least two wire harness to each other so that the hook-shaped members on the conducting portions are engaged with the loop-shaped members on the bridge portions.

According to the wire harness laminated structure and the wire harness attaching method of the present invention, the wire harness laminated structure can be used even when front and back surfaces of the wire harness are reversed, and also the cord providing space can be reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments according to the present invention will be explained with reference to the drawings hereinafter.

Figure 1:
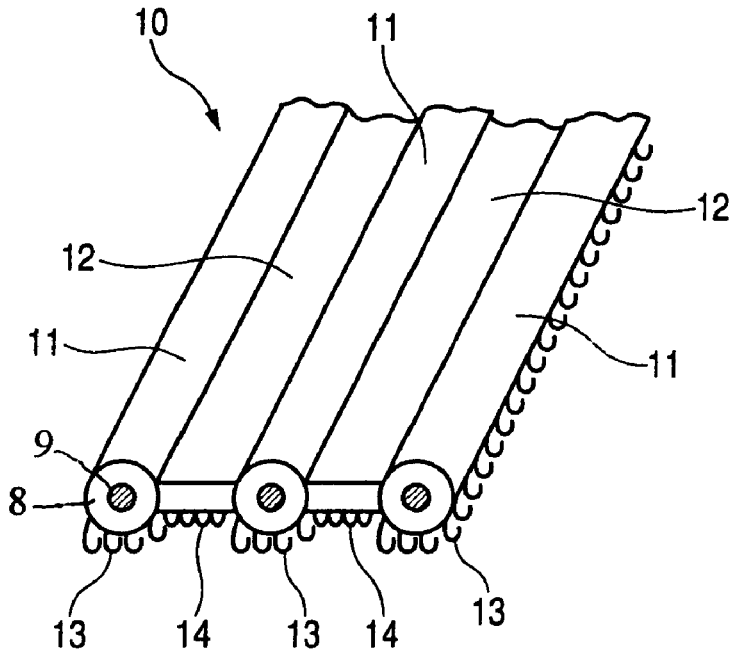
FIG. 1 is a perspective view showing a first embodiment of a wire harness according to the present invention.
Figure 2:
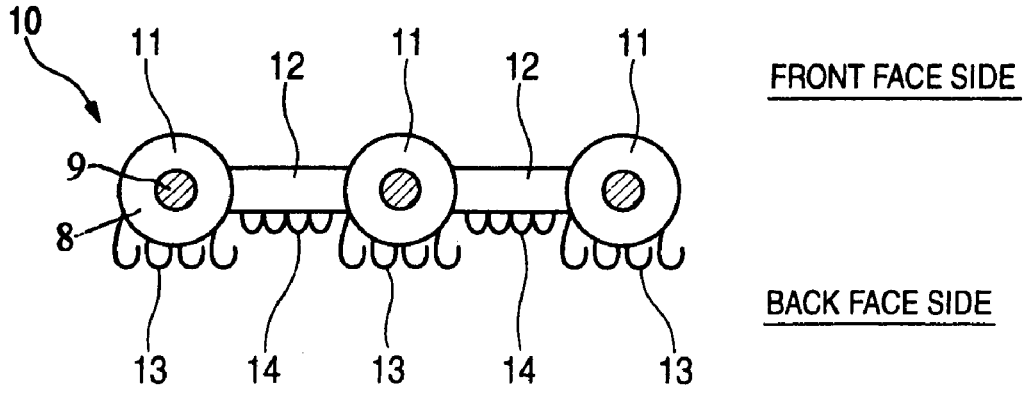
FIG. 2 is a front view showing the wire harness of the first embodiment.
Figure 3:
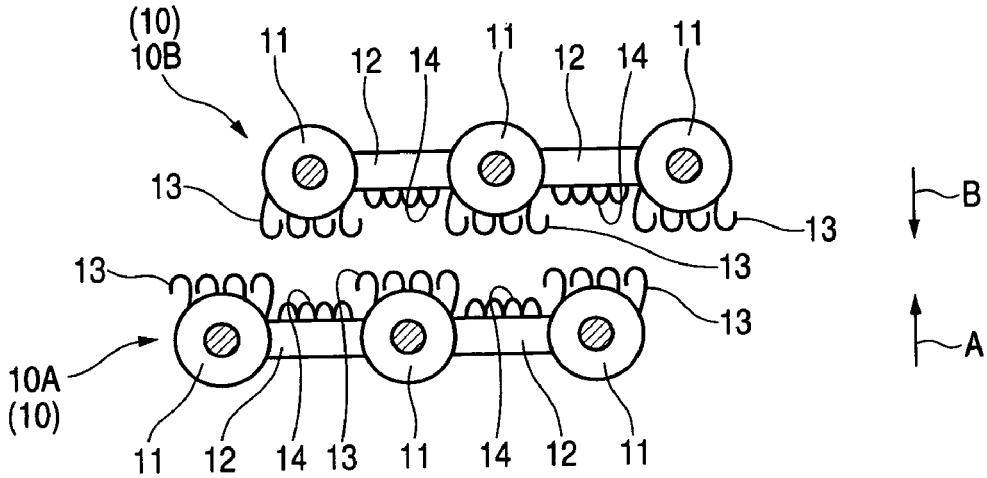
FIG. 3 is an exploded front view showing a wire harness attaching method of the first embodiment.
Figure 4:
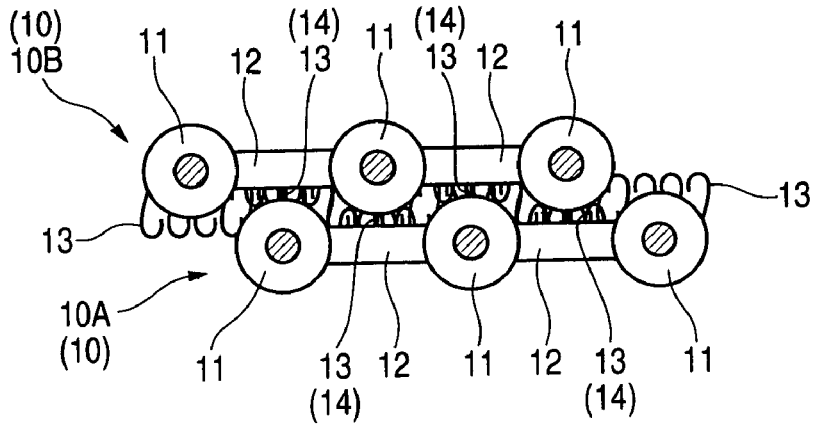
FIG. 4 is a front view showing a wire harness laminated state of the first embodiment.

A flat type wire harness 10 according to a first embodiment is shown in FIG. 1 and FIG. 2 respectively, and a wire harness attaching method of attaching a plurality of the wire harnesses 10 is shown in FIG. 3 and FIG. 4 respectively.

The wire harness 10 includes an insulating portion 8 that contain conductors 9 therein. More specifically, the wire harness includes cylindrical conducting portions 11 arranged in three rows, for example, and serving as an insulator portion made of a synthetic resin, or the like, and bridge portions 12 for coupling these conducting portions 11. The wire harness 10 is manufactured to have a predetermined length. Although not shown, a core electric wire as a predetermined conducting portion is contained in the inside of the conducting portion 11 to continue in one direction. The bridge portion 12 is formed like a thin plate whose thickness is smaller than a diameter of the conducting portion 11. This bridge portion 12 is provided on a line that connects both centers of neighboring conducting portions 11, and is provided to continue along the longitudinal direction of the conducting portion 11. In this case, the conducting portions 11 arranged in two rows or less or four rows or more may be employed, and also a shape is not limited to the cylindrical shape. For example, a prism shape, or the like may be employed.

In FIG. 1 and FIG. 2, supposing that the upper side is the front face side and the lower side is the back face side, a number of hook-shaped members 13 and a number of loop-shaped members 14 are implanted on the back face of the wire harness 10.

More particularly, a number of hook-shaped members 13 are implanted on the conducting portion 11 as a constituent member of the wire harness 10 along the longitudinal direction of the conducting portion 11. A number of loop-shaped members 14 are implanted on the bridge portion 12 along the longitudinal direction of the bridge portion 12. As the hook-shaped members 13 and the loop-shaped members 14, the so-called Magic Tape (registered trademark) is employed.

In attaching two sheets of wire harness 10 constructed as above, as shown in FIG. 3, first the back face of the first wire harness 10A and the front face of the second wire harness 10B are arranged to oppose to each other. In other words, the first wire harness 10A is arranged by reversing the above wire harness 10 to direct the hook-shaped members 13 and the loop-shaped members 14 of the first wire harness 10A upward, while the second wire harness 10B is arranged to direct the hook-shaped members 13 and the loop-shaped members 14 of the second wire harness 10B downward.

At this time, the wire harness 10A and the wire harness 10B are arranged to shift in their width direction such that the conducting portions 11 of the wire harness 10A are overlapped with the bridge portions 12 of the wire harness 10B respectively and also the bridge portions 12 of the wire harness 10A are overlapped with the conducting portions 11 of the wire harness 10B respectively. Then, when the wire harness 10A and the wire harness 10B are pushed in the directions indicated with arrows A, B mutually, the hook-shaped members 13 on the conducting portions 11 engage with the loop-shaped members 14 on the bridge portions 12 respectively. Thus, as shown in FIG. 4, both wire harnesses 10A, 10B are laminated. In this case, two sheets of laminated wire harnesses 10A, 10B are put into the interior finishing member, or the like and then fitted under the roof, or the like of the car.

According to the first embodiment, following advantages can be achieved.

In other words, two sheets of wire harnesses 10A, 10B have the conducting portions 11 and the bridge portions 12 a thickness of each of which is thinner than the conducting portion 11 respectively. Also, in attaching the wire harness 10A and the wire harness 10B, these wire harnesses are shifted mutually in their width direction to overlap the conducting portions 11 and the bridge portions 12 of the wire harness 10B with the bridge portions 12 and the conducting portions 11 of the wire harness 10A respectively. As a result, when the wire harnesses 10A, 10B are laminated, a total thickness can be reduced by a half of a thickness difference between the conducting portion 11 and the bridge portion 12 rather than the case where the conducting portions 11 are brought into contact with each other, and thus a cord providing space can be reduced.

Also, because the hook-shaped members 13 and the loop-shaped members 14 are implanted on the conducting portions 11 and the bridge portions 12 on the back face of the wire harness 10 respectively, the loop-shaped members 14 may be implanted on the bridge portions 12 subsequently without a reversal of the wire harness 10 after the hook-shaped members 13 are implanted on the hook-shaped members 13. As a result, a time and effect can be reduced, and the implantation of the hook-shaped members 13 and the loop-shaped members 14 can be facilitated.

Next, a second embodiment of the present invention will be explained with reference to FIG. 5 and FIG. 6 hereunder.

A wire harness 20 of the present embodiment is that the loop-shaped members 14 are implanted on the front face and also the hook-shaped members 13 are implanted on the back face.

Figure 5:
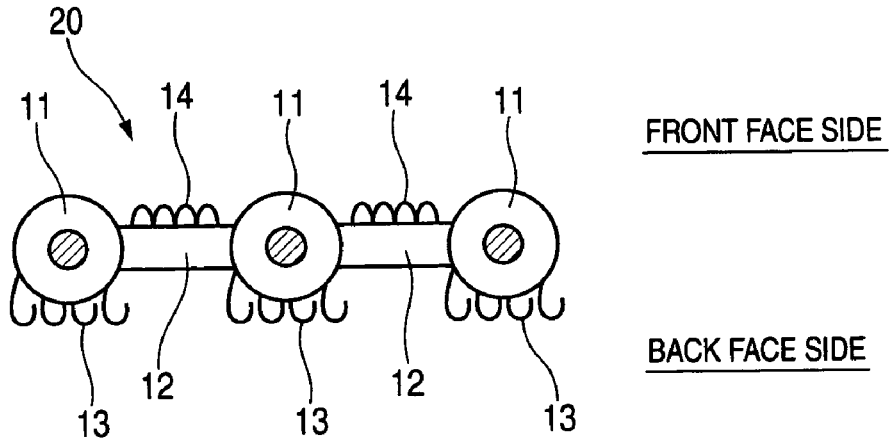
FIG. 5 is a front view showing a second embodiment of a wire harness according to the present invention.

As shown in FIG. 5, the wire harness 20 is formed to have the conducting portions 11 and the bridge portions 12. Also, the hook-shaped members 13 are implanted on the back face of the conducting portions 11, and the loop-shaped members 14 are implanted on the front face of the bridge portions 12.

Figure 6:
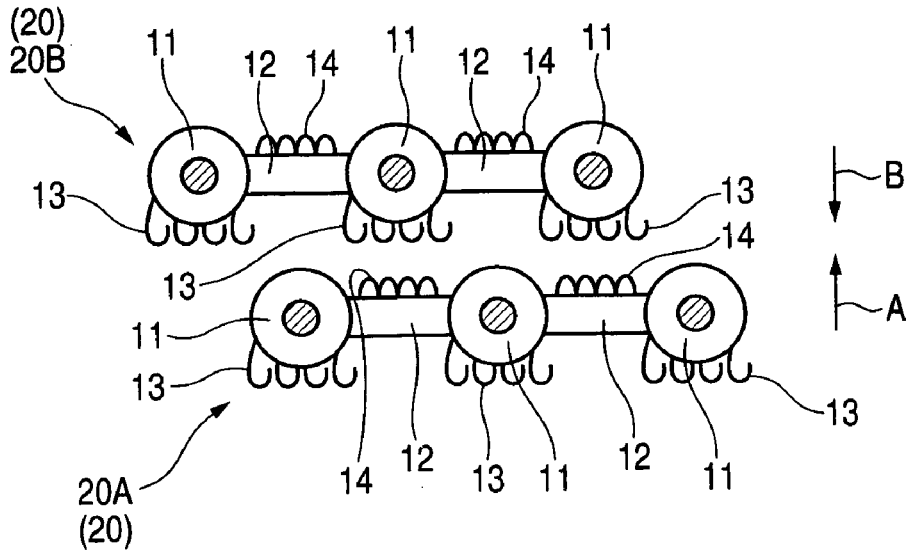
FIG. 6 is an exploded front view showing a wire harness attaching method of the second embodiment.

In attaching two sheets of wire harnesses 20 constructed as above, as shown in FIG. 6, first the front face of a first wire harnesses 20A and the back face of a second wire harnesses 20B are arranged to oppose to each other. That is, the first wire harnesses 20A is arranged to direct the loop-shaped members 14 upward and the second wire harnesses 20B is arranged to direct the hook-shaped members 13 downward.

At this time, the wire harness 20A and the wire harness 20B are arranged to shift in their width direction such that the conducting portions 11 of the wire harness 20A are overlapped with the bridge portions 12 of the wire harness 20B respectively and also the bridge portions 12 of the wire harness 20A are overlapped with the conducting portions 11 of the wire harness 20B respectively. Then, when the wire harness 20A and the wire harness 20B are pushed mutually in the directions indicated with arrows A, B, the hook-shaped members 13 on the conducting portions 11 engage with the loop-shaped members 14 on the bridge portions 12 respectively. Thus, both wire harnesses 20A, 20B are laminated mutually.

According to the second embodiment described above, the hook-shaped members 13 are implanted on the back faces of the conducting portions 11 of the first wire harness 20A. Therefore, the laminated wire harnesses 20A, 20B can be fitted to the interior finishing member of the roof, or the like of the car merely by pushing the hook-shaped members 13 against the flocked portion, or the like of the car. As a result, in addition to the advantage of the first embodiment such that a cord providing space can be reduced, such an advantage can be achieved that the laminated wire harnesses can be fixed without use of a separate fixing member.

Next, a third embodiment of the present invention will be explained with reference to FIG. 7 and FIG. 8 hereunder.

A wire harness 30 of the present embodiment is that the hook-shaped members 13 and the loop-shaped members 14 are implanted on both front and back faces.

Figure 7:
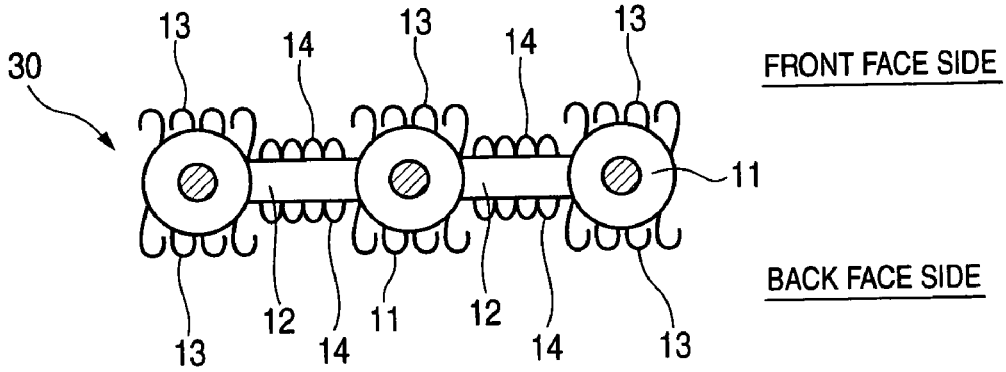
FIG. 7 is a front view showing a third embodiment of a wire harness according to the present invention.

As shown in FIG. 7, the wire harness 30 is formed to have the conducting portions 11 and the bridge portions 12. Also, the hook-shaped members 13 are implanted on both front and back faces of the conducting portions 11, and the loop-shaped members 14 are implanted on both front and back faces of the bridge portions 12.

Figure 8:
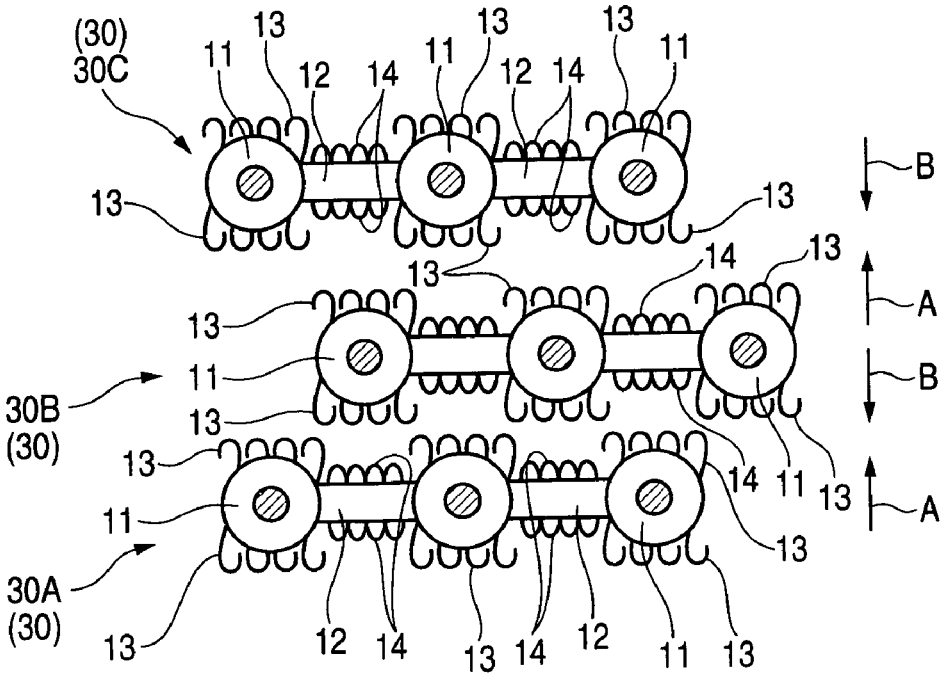
FIG. 8 is an exploded front view showing a wire harness attaching method of the third embodiment.

In attaching three sheets of wire harnesses 30 constructed as above, as shown in FIG. 8 first a first wire harnesses 30A and a second wire harnesses 30B are arranged to oppose to each other.

At this time, the wire harness 30A and the wire harness 30B are arranged to shift in their width direction such that the conducting portions 11 of the wire harness 30A are overlapped with the bridge portions 12 of the wire harness 30B respectively and also the bridge portions 12 of the wire harness 30A are overlapped with the conducting portions 11 of the wire harness 30B respectively. Then, when the wire harness 30A and the wire harness 30B are pushed mutually in the directions indicated with arrows A, B, the hook-shaped members 13 on the conducting portions 11 engage with the loop-shaped members 14 on the bridge portions 12 respectively. Thus, both wire harnesses 30A, 30B are laminated mutually.

Then, a third wire harness 30C is opposed to two sheets of laminated wire harnesses 30A, 30B to shift in its width direction such that the conducting portions 11 of the wire harness 30B are overlapped with the bridge portions 12 of the wire harness 30C respectively and also the bridge portions 12 of the wire harness 30B are overlapped with the conducting portions 11 of the wire harness 30C respectively. Then, as described above, when the wire harness 30A, the wire harness 30B, and the wire harness 30C are pushed mutually in the directions indicated with arrows A, B, the hook-shaped members 13 on the conducting portions 11 engage with the loop-shaped members 14 on the bridge portions 12 respectively. Thus, the wire harness 30C is stacked on two sheets of laminated wire harnesses 30A, 30B are laminated.

According to the third embodiment described above, the hook-shaped members 13 and the loop-shaped members 14 are implanted on both front and back faces of the conducting portions 11 and the bridge portions 12 of the laminated wire harnesses 30A, 30B, 30C respectively. Therefore, plural sheets of wire harnesses 30A, and the like can be laminated only by pushing them after the wire harnesses are arranged to overlap the mutual conducting portions 11 and the mutual bridge portions 12 respectively, and thus it is not required of the worker to check which one of the front face and the back face of the wire harnesses 30B, or the like in his or her hand is prepared to laminate. As a result, in addition to the advantage of the first embodiment such that a cord providing space can be reduced and the advantage of the second embodiment such that the fixing member can be omitted, such an advantage can be achieved that the fitting operation can be applied in a situation that the wire harness is reversed and also such fitting operation can be facilitated.

Figure 9:
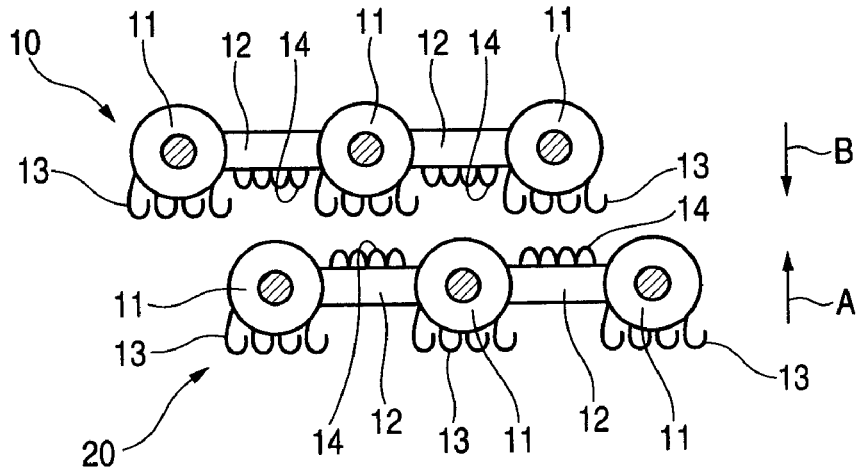
FIG. 9 is an exploded front view showing a wire harness attaching method according to a variation of the present invention.
Figure 10:
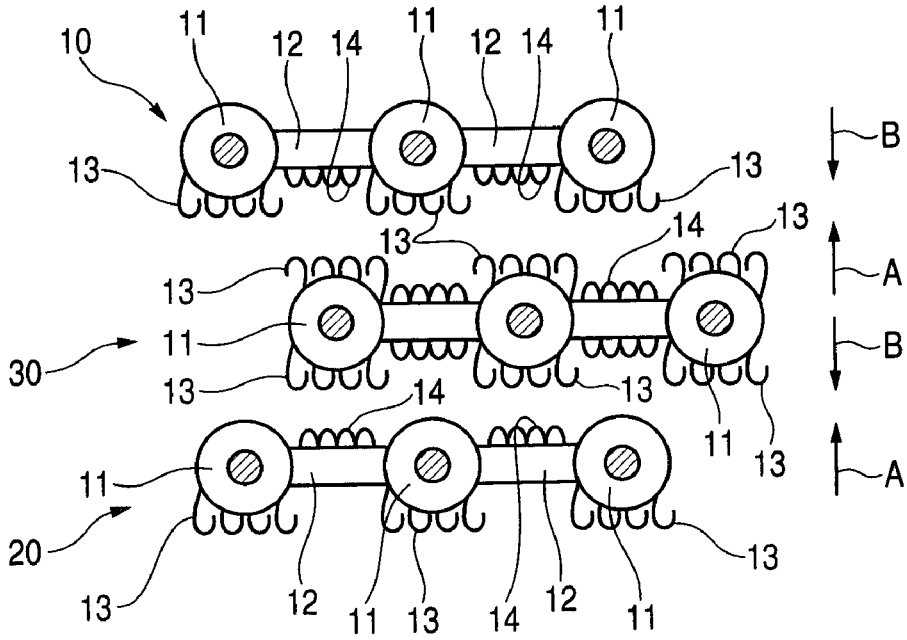
FIG. 10 is an exploded front view showing a wire harness attaching method according to another variation of the present invention.
Figure 11:
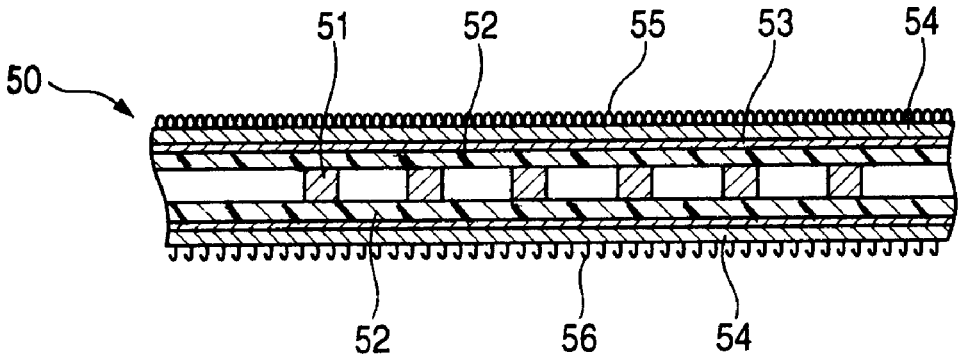
FIG. 11 PRIOR ART
FIG. 11 is a longitudinal sectional view showing a wire harness in the related art.
Figure 12:
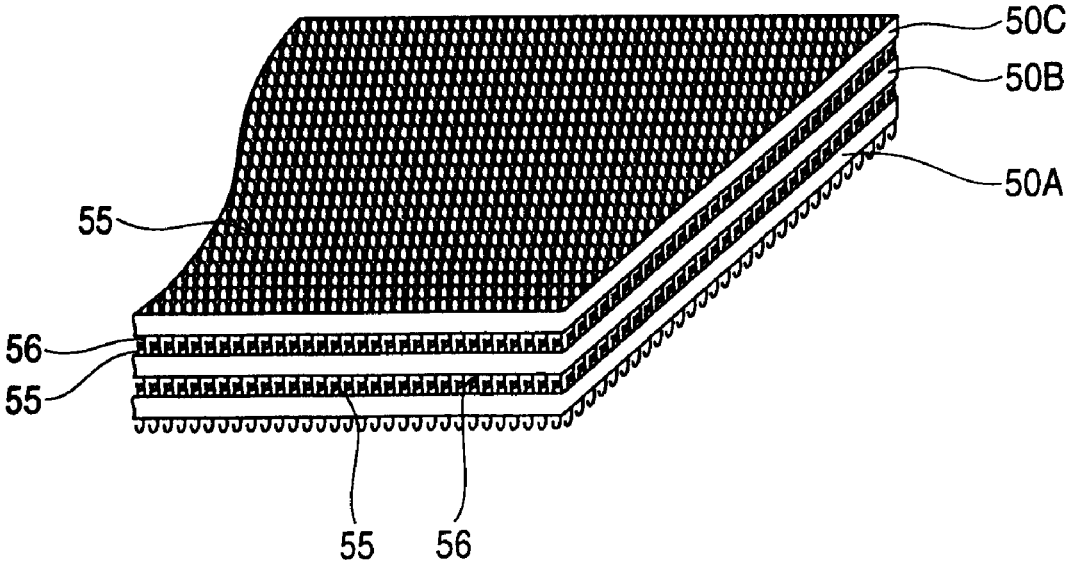
FIG. 12 PRIOR ART
FIG. 12 is a longitudinal sectional view showing a wire harness laminated structure in the related art.

In this case, the present invention is not limited to above embodiment, and variations and improvements can be applied appropriately. For example, in the above embodiments, the wire harnesses 10, 20, 30 having the same shape respectively are prepared and then laminated by arranging them such that the conducting portions 11 and the bridge portions 12 are overlapped with each other. But the present invention is not limited to the above. As shown in FIG. 9 and FIG. 10, the wire harnesses in respective embodiments may be used appropriately in combination.

In a wire harness attaching method shown in FIG. 9, the wire harness 10 of the first embodiment and the wire harness 20 of the second embodiment are combined mutually. That is, the wire harness 10 of the first embodiment and the wire harness 20 of the second embodiment are opposed to shift in the width direction and then arranged such that the conducting portions 11 and the bridge portions 12 of respective wire harnesses are overlapped with each other. Then, as described above, the wire harness 10 and the wire harness 20 arc laminated by pushing them in the directions indicated with arrows A, B mutually.

With this configuration, since the hook-shaped members 13 are implanted on the back faces of the conducting portions 11 in the wire harness 20 of the second embodiment, the wire harness 20 can be fitted to the interior finishing portion such as the roof, or the like of the car only by pushing the hook-shaped members 13 against the flocked portion if any. As a result, there is no need to prepare a separate fixing tool member that is used to fix the laminated wire harnesses 10, 20. Also, even when two sheets of wire harnesses 10, 20 are jointed together and then fitted to the roof, or the like of the car, a cord providing space can be reduced because the conducting portions 11 and the bridge portions 12 are stacked mutually.

Also, in a wire harness laminated structure shown in FIG. 10, the wire harness 30 of the third embodiment is put between the wire harness 10 of the first embodiment and the wire harness 30 of the second embodiment, and then laminated. In other words, the front face of the wire harness 20 and the back face of the wire harness 20 are opposed and then arranged such that the conducting portions 11 and the bridge portions 12 of respective wire harnesses are overlapped with each other, and then the hook-shaped members 13 on the conducting portions 11 and the loop-shaped members 14 on the bridge portions 12 are engaged with each other by pushing mutually the wire harnesses in the directions indicated with arrows A, B. Thus, the wire harness 20 and the wire harness 30 are jointed together.

Then, the front face of the wire harness 30 and the back face of the wire harness 10 are opposed and then arranged such that the conducting portions 11 and the bridge portions 12 of respective wire harnesses are overlapped with each other, and then the hook-shaped members 13 on the conducting portions 11 and the loop-shaped members 14 on the bridge portions 12 are engaged with each other. Thus, the wire harness 20 and the wire harness 30 cab be jointed together. As a result, even when three sheets of wire harnesses 10, 20, 30 are jointed together and then fitted to the roof, or the like of the car, a cord providing space can be reduced because the conducting portions 11 and the bridge portions 12 are stacked mutually.

Here, the invention of this application is not limited to the above embodiments. For example, in the above embodiments, the hook-shaped members 13 are implanted on the conducting portions 11 and also the loop-shaped members 14 are implanted on the bridge portions 12. But the loop-shaped members 14 may be implanted on the conducting portions 11 and also the hook-shaped members 13 may be implanted on the bridge portions 12.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-044235 filed on Feb. 21, 2005, the contents of which are incorporated herein for reference.

What is claimed is:

1. A wire harness, comprising:

an insulating member that contains a conductor therein, the conductor extending along one direction, and the insulating member having a front face and a back face that is opposed to the front face; and a plurality of hook-shaped members and a plurality of loop-shaped members both of which are provided together on at least one of the front face and the back face of the insulating member, wherein the hook-shaped members are engageable to loop shaped members of a mating wire harness to be attached to the wire harness; and wherein the loop-shaped members are engageable to hook shaped members of the mating wire harness.

2. The wire harness according to claim 1, wherein the insulating member includes a plurality of conducting portions and a plurality of bridge portions that couple the conducting portions;

wherein the conducting portions are arranged at a predetermined interval and have a plurality of the conductors respectively;

wherein a thickness of the bridge portions is smaller than that of the conducting portions;

wherein the hook-shaped members are provided on at least one of front faces and back faces of the conducting portions; and wherein the loop-shaped members are provided on at least one of front face and back face of the bridge portions.

3. The wire harness according to claim 2, wherein the hook-shaped members are provided on both the front faces and the back faces of the conducting portions, and wherein the loop-shaped members are provided on both the front faces and the back faces of the bridge portions.

4. The wire harness according to claim 2, wherein the hook-shaped members are provided on either the front faces or the back faces of the conducting portions, and wherein the loop-shaped members are provided on either the front faces or the back faces of the bridge portions.

5. An attaching method of wire harnesses according to claim 2, comprising:

arranging at least two wire harnesses so as to be opposed to and shifted to each other so that the conducting portions of the respective wire harnesses are opposed to the bridge portions of the respective wire harnesses; and attaching the at least two wire harness to each other so that the hook-shaped members on the conducting portions are engaged with the loop-shaped members on the bridge portions.

6. A wire harness, comprising:

an insulating member that contains a conductor therein, the conductor extending along one direction, and the insulating member having a front face and a back face that is opposed to the front face;

a plurality of hook-shaped members that are provided on only one of the front face and the back face of the insulating member; and a plurality of loop-shaped members that are provided on only the other of the front face and the back face of the insulating member;

wherein the hook-shaped members are engageable to loop shaped members of a mating wire harness to be attached to the wire harness; and wherein the loop-shaped members are engageable to hook shaped members of the mating wire harness.

* * * * *